US010480253B2

(12) United States Patent
Vempati et al.

(10) Patent No.: US 10,480,253 B2
(45) Date of Patent: Nov. 19, 2019

(54) CUTTING ELEMENTS, EARTH-BORING TOOLS INCLUDING CUTTING ELEMENTS, AND METHODS OF FORMING CUTTING ELEMENTS

(71) Applicant: Baker Hughes, a GE Company, Houston, TX (US)

(72) Inventors: Chaitanya K. Vempati, Conroe, TX (US); Konrad T. Izbinski, The Woodlands, TX (US); Suresh G. Patel, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 729 days.

(21) Appl. No.: 14/975,063

(22) Filed: Dec. 18, 2015

(65) Prior Publication Data

US 2017/0175452 A1 Jun. 22, 2017

(51) Int. Cl.
*E21B 10/567* (2006.01)
*E21B 10/54* (2006.01)

(52) U.S. Cl.
CPC ..... *E21B 10/5673* (2013.01); *E21B 10/54* (2013.01)

(58) Field of Classification Search
CPC ..... E21B 10/5673; E21B 10/54
USPC ..... 175/430
See application file for complete search history.

(56) References Cited

U.S. PATENT DOCUMENTS 5,740,874 A 4/1998 Matthias
5,881,830 A 3/1999 Cooley
6,009,963 A * 1/2000 Chaves ..... E21B 10/5676 175/432
7,730,977 B2 6/2010 Achilles
8,783,387 B2 7/2014 Durairajan et al.
2005/0082093 A1 4/2005 Keshavan et al.
2009/0114628 A1 5/2009 DiGiovanni
2010/0059287 A1* 3/2010 Durairajan ..... E21B 10/5673 175/420.2
2013/0306377 A1* 11/2013 DiGiovanni ..... E21B 10/5673 175/65
2014/0166371 A1 6/2014 Whittaker
2015/0259986 A1 9/2015 Stockey

OTHER PUBLICATIONS

Stockey et al,, U.S. Appl. No. 14/656,036, entitled Cutting Elements Configured to Mitigate Diamond Table Failure, Earth-Boring Tools Including Such Cutting Elements, and Related Methods, filed Mar. 12, 2015.
International Search Report for International Application No. PCT/US2016/066911 dated Apr. 4, 2017, 3 pages.
International Written Opinion for International Application No. PCT/US2016/066911 dated Apr. 4, 2017, 9 pages.

* cited by examiner

*Primary Examiner* — Anna M Momper
*Assistant Examiner* — Patrick F Lambe
(74) *Attorney, Agent, or Firm* — TraskBritt

(57) ABSTRACT

A cutting element comprises a cutting table of a polycrystalline hard material including a cutting face, a sidewall, and at least one peripheral cutting edge portion between the cutting face and the sidewall. A radius of curvature of the peripheral cutting edge portion is greater than a radius of curvature of at least another peripheral edge portion between the cutting face and the sidewall. An earth-boring tool may include one or more such cutting elements.

20 Claims, 5 Drawing Sheets

CUTTING ELEMENTS, EARTH-BORING TOOLS INCLUDING CUTTING ELEMENTS, AND METHODS OF FORMING CUTTING ELEMENTS

TECHNICAL FIELD

Embodiments of the disclosure relate to cutting elements, to earth-boring tools including cutting elements, and to methods of forming cutting elements.

BACKGROUND

Earth-boring tools for forming wellbores in subterranean formations may include cutting elements secured to a body. For example, a fixed cutter earth-boring rotary drill bit ("drag bit") may include cutting elements fixedly attached to a bit body thereof. As another example, a roller cone earth-boring rotary drill bit may include cutting elements secured to cones mounted on bearing pins extending from legs of a bit body. Other examples of earth-boring tools utilizing cutting elements include, but are not limited to, core bits, bi-center bits, eccentric bits, hybrid bits (e.g., rolling components in combination with fixed cutting elements), reamers, and casing milling tools.

Cutting elements used in earth-boring tools often include a supporting substrate and cutting table, the cutting table comprises a volume of superabrasive material, such as a volume of polycrystalline diamond ("PCD") material, on or over the supporting substrate. Surfaces of the cutting table act as cutting surfaces of the cutting element. During a drilling operation, cutting edges at least partially defined by peripheral portions of the cutting surfaces of the cutting elements are forced into contact with the formation. As the earth-boring tool moves (e.g., rotates) relative to the subterranean formation, the cutting elements are moved across surfaces of the subterranean formation and the cutting edges shear away formation material.

During a drilling operation, the cutting elements of an earth-boring tool may be subjected to high temperatures (e.g., due to friction between the cutting table and the subterranean formation being cut), high axial loads (e.g., due to the weight-on-bit (WOB)), and high impact forces (e.g., due to variations in WOB, formation irregularities, transitions between different formation materials, vibration, etc.). High temperature conditions can result in undesirable wear (e.g., formation of wear flats, dulling), while high axial loads and impact forces may result in damage (e.g., chipping, spalling) to the PCD material of the cutting tables of the cutting elements. The wear and/or damage often occurs at or near the cutting edges of the cutting tables, and can result in one or more of decreased cutting efficiency, separation of the cutting tables from the supporting substrates of the cutting elements, and separation of the cutting elements from the earth-boring tool to which they are secured.

For example, as mentioned above, wear flats may form from the cutting edges of the cutting tables rearwardly into sides of the cutting tables and ultimately into the sides of the supporting substrates. Such wear flats may be particularly undesirable where the cutting table is formed as a so-called "leached" polycrystalline diamond compact diamond table. A leached diamond table may be formed by leaching a catalyst material (e.g., cobalt) used to stimulate formation of the polycrystalline diamond compact from interstitial spaces between the inter inter-bonded diamond crystals in the diamond table using, for example, an acid or combination of acids (e.g., aqua regia). The catalyst material is generally removed from exterior portions of the diamond table to a depth from the cutting surfaces. For example, the catalyst material may be removed from the cutting face, from a portion of the side surface of the diamond table, or both, to a desired depth or depths within the diamond table, but without leaching all of the catalyst material out from an interior of the diamond table and a portion of the diamond table side surface adjacent to the supporting substrate. The leached portion of such a diamond table configuration results in enhanced thermal stability of the diamond table at and adjacent to the cutting edge, reducing the wear rate of the diamond and maintaining cutting efficiency, while the unleached portion provides structural strength against loading and impact. However, formation of wear flats may act to remove a majority or all of the leached portion of the diamond table, leaving mainly non-leached portions of the cutting table and resulting in decreased cutting efficiency, an increased wear rate and/or premature failure of the cutting table.

Accordingly, it would be desirable to have cutting elements with leached diamond tables, earth-boring tools (e.g., rotary drill bits) bearing such cutting elements, and methods of forming and using such cutting elements and earth-boring tools so equipped offering enhanced cutting efficiency and prolonged operational life during drilling operations as compared to conventional cutting elements with leached diamond tables, conventional earth-boring tools bearing such conventional cutting elements, and conventional methods of forming and using such conventional cutting elements and earth-boring tools so equipped.

BRIEF SUMMARY

Embodiments described herein include cutting elements, earth-boring tools including cutting elements, and methods of forming cutting elements. For example, in accordance with one embodiment, a cutting element comprises a cutting table of a polycrystalline hard material including a cutting face, a sidewall, and at least one peripheral cutting edge portion between the cutting face and the sidewall. A radius of curvature of the peripheral cutting edge portion is greater than a radius of curvature of at least another peripheral edge portion between the cutting face and the sidewall.

In additional embodiments, an earth-boring tool comprises cutting elements secured to at least one structure. At least some of the cutting elements independently comprise a cutting table comprising a polycrystalline compact of hard material. The cutting table comprises a cutting face, a sidewall, and at least one peripheral cutting edge portion positioned between the cutting face and the sidewall. The at least one peripheral cutting edge portion is positioned on the at least one structure at a location in which the at least one peripheral cutting edge portion will engage a subterranean formation to remove material therefrom during operation of the earth-boring tool. A radius of curvature of an outermost extent of the peripheral cutting edge portion is greater than a radius of curvature of an outermost extent of the cutting table.

In yet additional embodiments, an earth-boring tool comprises cutting elements secured to at least one structure. At least some of the cutting elements independently comprise .a cutting table comprising a polycrystalline compact of hard material. The cutting table comprises a cutting face, a sidewall, a chamfered surface extending between the cutting face and the at least one sidewall, and peripheral cutting edge portions defined at at least one interface between the chamfered surface and the at least one sidewall. Each peripheral cutting edge portion of the peripheral cutting edge portions is configured to be selectively positioned on the at least one structure in a position where the respective peripheral cutting edge portion will engage a subterranean formation to remove material therefrom. A radius of curvature of each of the peripheral cutting edge portions is greater than a radius of curvature of the at least another peripheral edge portion of the cutting table between the cutting face and the at least one sidewall.

DETAILED DESCRIPTION

Figure 1:
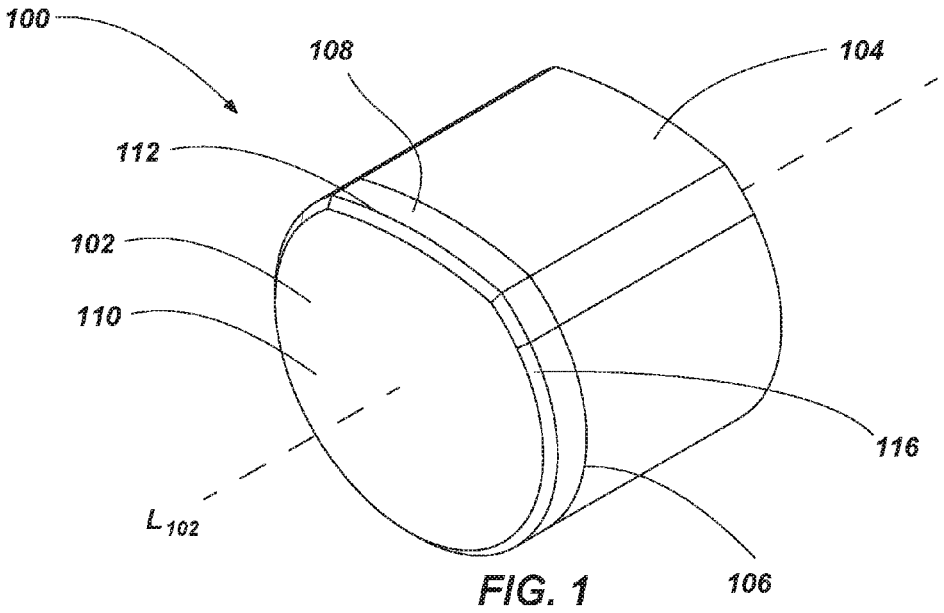
FIG. 1 is a perspective view of a cutting element in accordance with an embodiment of the disclosure.

Cutting elements for use in earth-boring tools are described, as are earth-boring tools including cutting elements, and methods of forming and using cutting elements and earth-boring tools. In some embodiments, a cutting element includes a cutting table attached to a supporting substrate. The cutting table includes at least one non-uniform cutting portion (e.g., an edge defined at an interface between the cutting face of the cutting table and a side (e.g., side surface, sidewall) of the cutting table (e.g., at an interface between a chamfered surface at a periphery of the cutting face and the sidewall of the cutting table). For example, a periphery of the at least one non-uniform cutting edge non-uniform relative to another portion of the cutting table, as discussed below in greater detail and may exhibit a radius of curvature that is greater than a radius of the cutting table. Such a configuration of cutting elements and earth-boring tools described herein may provide enhanced drilling efficiency and improved operational life as compared to the configurations of conventional cutting elements and conventional earth-boring tools. For example, as discussed below, such a cutting element will produce a wear flat that is relatively smaller (e.g., shallower) in overall depth (e.g., a depth extending into the cutting table) as compared to a wear flat on a conventional cutting element. In some embodiments, a cutting element providing such a shallower wear flat will lengthen the amount of run time of the cutting element before the wear flat extends a selected depth into the cutting table. For example, such a cutting element may extend the amount of run time before a non-leached portion of the diamond cutting table is exposed by the extension of the wear flat past the leached portion of the cutting table.

The following description provides specific details, such as specific shapes, specific sizes, specific material compositions, and specific processing conditions, in order to provide a thorough description of embodiments of the present disclosure. However, a person of ordinary skill in the art would understand that the embodiments of the disclosure may be practiced without necessarily employing these specific details. Embodiments of the disclosure may be practiced in conjunction with conventional fabrication techniques employed in the industry. In addition, the description provided below may not form a complete process flow for manufacturing a cutting element or earth-boring tool. Only those process acts and structures necessary to understand the embodiments of the disclosure are described in detail below. Additional acts to form a complete cutting element or a complete earth-boring tool from the structures described herein may be performed by conventional fabrication processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or descried as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "comprising," "including," "containing," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature, or method act indicates that such is contemplated for use in implementation of an embodiment of the disclosure and such term is used in preference to the more restrictive term "is" so as to avoid any implication that other, compatible materials, structures, features, and methods usable in combination therewith should or must be excluded.

As used herein, the terms "longitudinal," "vertical," "lateral," and "horizontal" are in reference to a major plane of an element and are not necessarily defined by Earth's gravitational field. A "lateral" or "horizontal" direction is a direction that is substantially parallel to the major plane of the element, while a "longitudinal" or "vertical" direction is a direction that is substantially perpendicular to the major plane of the element. The major plane of the element is defined by a surface of the element having a relatively large area compared to other surfaces of the element.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the terms "earth-boring tool" and "earth-boring drill bit" mean and include any type of bit or tool used for drilling during the formation or enlargement of a wellbore in a subterranean formation and include, for example, fixed-cutter bits, roller cone bits, percussion bits, core bits, eccentric bits, bi-center bits, reamers, mills, drag bits, hybrid bits (e.g., rolling components in combination with fixed cutting elements), and other drilling bits and tools known in the art.

As used herein, the term "polycrystalline compact" means and includes any structure comprising a polycrystalline material formed by a process that involves application of pressure (e.g., compaction) to the precursor material or materials used to form the polycrystalline material. In turn, as used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "hard material" means and includes any material having a Knoop hardness value of greater than or equal to about 3,000 $Kg_f/mm^2$ (29,420 MPa). Non-limiting examples of hard materials include diamond (e.g., natural diamond, synthetic diamond, or combinations thereof), and cubic boron nitride.

FIG. 1 illustrates a cutting element 100 in accordance with an embodiment of the disclosure. The cutting element 100 includes a cutting table 102 secured (e.g., attached, bonded, etc.) to a supporting substrate 104 at an interface 106. The supporting substrate 104 may be formed of include a material that is relatively hard and resistant to wear. By way of non-limiting example, the supporting substrate 104 may be formed from and include a ceramic-metal composite material (also referred to as a "cermet" material). In some embodiments, the supporting substrate 104 is formed of and includes a cemented carbide material, such as a cemented tungsten carbide material, in which tungsten carbide particles are cemented together by a metallic binder material. As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide. The metallic binder material may include, for example, a metal-solvent catalyst material useful in catalyzing the formation of inter-granular bonds between diamond grains in the manufacture of polycrystalline diamond compacts. Such metal-solvent catalyst materials include, for example, cobalt, nickel, iron, and alloys and mixtures thereof In some embodiments, the supporting substrate 104 is formed of and includes a cobalt-cemented tungsten carbide material.

The supporting substrate 104 may exhibit any desired peripheral geometric configuration (e.g., peripheral shape and peripheral size). The supporting substrate 104 may, for example, exhibit a peripheral shape and a peripheral size at least partially complementary to (e.g., substantially similar to) a peripheral geometric configuration of at least a portion (e.g., an entirety) of the cutting table 102. For example, the lateral periphery (e.g., extending about a longitudinal axis $L_{102}$ of the cutting table 102) of both the substrate 104 and the cutting table 102 may be uniform. The peripheral shape and the peripheral size of the supporting substrate 104 may be configured to permit the supporting substrate 104 to be received within and/or located upon an earth-boring tool, as described in further detail below.

In some embodiments, the interface 106 between the supporting substrate 104 and the cutting table 102 (e.g., opposing surfaces of the supporting substrate 104 and the cutting table 102) may be substantially planar, or may be of non-planar topography (e.g., curved, angled, jagged, sinusoidal, V-shaped, U-shaped, irregularly shaped, combinations thereof, etc.).

In further embodiments, the cutting table 102 may be employed and/or formed without the supporting substrate 104 (e.g., the supporting substrate 104 may be absent, such that the cutting table 102 is employed and/or formed as a freestanding structure).

The cutting table 102 may be positioned on or over the supporting substrate 104, and includes at least one sidewall 108 (e.g., side surface), at least one cutting surface (e.g., cutting face 110) opposite the interface 106 between the supporting substrate 104 and the cutting table 102, and at least one cutting edge 112 at an interface between chamfered surface 116 at a periphery of the cutting face 110 and the sidewall 108 of the cutting table 102 (e.g., a peripheral cutting edge portion). The cutting edge 112 may be defined on the cutting table 102 (and positioned on the overall tool, as discussed below) in order to provide a primary cutting action of the cutting table 102. For example, the cutting edge 112 may be positioned on the cutting table 102 (e.g., at periphery of the cutting table 102) and the overall tool in a location in which the cutting edge 112 will primarily engage and shear material from a subterranean formation as compared to other portions of the cutting table 102 (e.g., the remaining circumference of the cutting table 102).

The cutting table 102 may be formed of and include at least one hard material, such as at least one polycrystalline material. In some embodiments, the cutting table 102 is formed of and includes a PCD material. For example, the cutting table 102 may be formed from diamond particles (also known as "diamond grit") mutually bonded in the presence of at least one catalyst material (e.g., at least one Group VIII metal, such as one or more of cobalt, nickel, and iron; at least one alloy including a Group VIII metal, such as one or more of a cobalt-iron alloy, a cobalt-manganese alloy, a cobalt-nickel alloy, cobalt-titanium alloy a cobalt-nickel-vanadium alloy, an iron-nickel alloy, an iron-nickel-chromium alloy, an iron-manganese alloy, an iron-silicon alloy, a nickel-chromium alloy, and a nickel-manganese alloy; combinations thereof; etc.). The diamond particles may comprise one or more of natural diamond and synthetic diamond, and may include a monomodal distribution or a multimodal distribution of particle sizes. In additional embodiments, the cutting table 102 is formed of and includes a different polycrystalline material, such as one or more of polycrystalline cubic boron nitride, a carbon nitride, and another hard material known in the art. In some embodiments, the cutting table 102 may comprise a gradient configuration. For example, an upper or outer portion of the table 102 (e.g., the cutting edge 112) may be tailored (e.g., through selection of materials, leaching, etc.) to exhibit a relatively higher abrasion resistance while the lower or inner portion of the cutting table 102 may exhibit a relatively lower abrasion resistance.

As shown in FIG. 1, the cutting table 102 includes the at least one non-uniform cutting portion (e.g., the cutting edge 112, before the cutting table 102 is used to engage a formation) defined at an interface between the cutting face 110 of the cutting table 102 and the sidewall 108 of the cutting table 102. Stated in another way, the cutting edge 112 may exhibit a geometry that is different from at least one other portion of the cutting table 102 or of the cutting element 100. For example, the cutting edge 112 may exhibit a radius of curvature that is greater than a radius (e.g., an overall or average radius, an overall or an average radius of curvature) of the cutting table 102.

Figure 2:
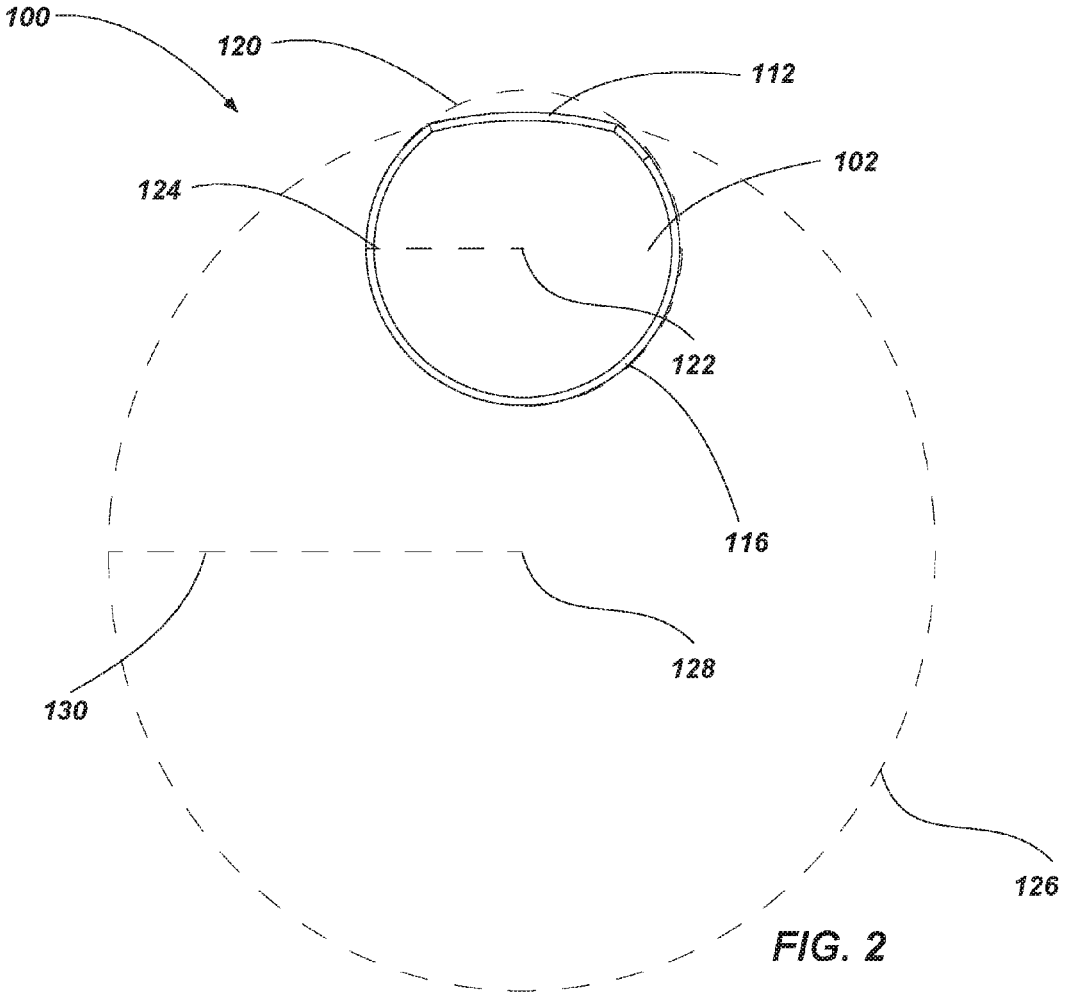
FIG. 2 is a front view of the cutting element of FIG. 1 illustrated with geometric reference lines, shown in dashed lines for the sake of clarity.

FIG. 2 is a front view of the cutting element 100 of FIG. 2 illustrated with geometric reference lines (e.g., references indicated the relative radius of curvature for various portions of the cutting element 100, which are shown in dashed lines for the sake of clarity). Referring to FIGS. 1 and 2, reference circle 120 is shown bounding the circumference (e.g., the outermost circumference of the cutting table 102) about the longitudinal axis $L_{102}$ (e.g., centerline) of the cutting table 102 in a direction transverse (e.g., perpendicular) to the cutting face 110 of the cutting table 102. The origin 122 of the reference circle 120 may be positioned on with the longitudinal axis $L_{102}$ of the cutting table 102 and an axis extending through the origin 122 of the reference circle 120 parallel with the longitudinal axis $L_{102}$ may extend along (e.g., may be coextensive with, coaxial with) the longitudinal axis $L_{102}$ of the cutting table 102. The reference circle 120 exhibits a radius 124 that defines the radius of curvature for the cutting table 102.

In a similar manner, reference circle 126 is shown bounding the cutting edge 112 (e.g., the curvature or arc of the cutting edge 112). The origin 128 of the reference circle 126 may be offset from the longitudinal axis $L_{102}$ of the cutting table 102 and an axis extending through the origin 128 of the reference circle 126 may be parallel with the longitudinal axis $L_{102}$ and offset from the longitudinal axis $L_{102}$ (e.g., not coextensive or coaxial with the longitudinal axis $L_{102}$ of the cutting table 102). The reference circle 126 exhibits a radius 128 that defines the radius of curvature for the cutting table 102. As depicted, the radius of curvature 130 that is defined by the cutting edge 112 is greater than the radius of curvature 124 that is defined by the cutting table 102 (e.g., the overall cutting table 102). In some embodiments, the radius of curvature 130 of the cutting edge 112 may be one and a tenth times (110%), one and a quarter times (125%), one and a half times (150%), two times (200%), three times (300% or greater) larger than the radius of curvature 124 that is defined by the overall cutting table 102. Stated in another way, the cutting edge 112 may exhibit a curvature that is less than a curvature of an adjacent portion of a periphery of the cutting table 102.

In some embodiments, the curvature of the cutting edge 112 may be or may be approaching a linear configuration where the curvature is or approximately is zero and the radius of curvature is or is approaching infinity. In such an embodiment, the radius of curvature 130 of the cutting edge 112 would be much larger than the radius of curvature 124 that is defined by the overall cutting table 102 (e.g., by one or more orders of magnitude).

In some embodiments, where one of both of the cutting edge 112 and the outer portion of the cutting table 102 does not exhibit a uniform surface having a majority that coextends with a reference circle (e.g., reference circle 120, 126), the respective reference circles 120, 126 may be defined as bounding a select portion (e.g., the outermost extent, the innermost extent, the average extent) of the cutting edge 112 or the outer portion of the cutting table 102 in order to define the respective radius of curvatures 124, 130. For example, the respective reference circles 120, 126 may be defined as bounding the outermost extent (e.g., curvature or circumference) of a majority (e.g., more than half, three-fourths, an entirety) of the cutting edge 112 or the outer portion of the cutting table 102 in order to define the respective radius of curvatures 124, 130.

In some embodiments, the cutting edge 112 may define an arc that is at least partially coextensive with the reference circle 120. For example, a majority (e.g., an entirety) of the arc of the cutting edge 112 may be coextensive with the reference circle 120.

In some embodiments, the cutting table 102 may have a chamfered surface 116 at an intersection of the cutting face 110 and the sidewall 108 of the cutting table 102. While chamfered surface 116 of the cutting table 102 shown in FIGS. 1 and 2 comprises a single chamfer, the chamfered edge 116 may have additional chamfer surfaces, and such chamfer surfaces may be oriented at chamfer angles that differ from the chamfer angle of the chamfer surface as illustrated in the figures. In some embodiments, the chamfered edge 116 may extend a distance of 0.1 inch (2.54 millimeters) to 0.001 inch (0.0254 millimeter) (e.g., 0.01 inch (0.254 millimeter), 0.016 inch (0.4064 millimeter), etc.).

In additional embodiments, only a portion of the cutting table 102 may have the chamfered edge 116 (e.g., the cutting edge 112 or the remainder of the cutting table 102 outside of the cutting edge 112). In yet additional embodiments, the cutting table 102 may lack a chamfered surface (e.g., the cutting face 110 and the sidewall 108 of the cutting table 102 may form a substantially ninety-degree angle).

In some embodiments, the cutting element 100 may include one or more non-planar portions (e.g., non-planar cutting faces 110), such as those disclosed in pending United States Patent Pub. No. US 2015/0259986, filed Mar. 17, 2014, and assigned to the assignee of the disclosure, the entire disclosure of which is hereby incorporated herein by this reference. In some embodiments, the cutting element 100 may include one or more non-planar portions, such as, for example, grooves (e.g., conical grooves), recesses, projecting features (e.g., cones, spheres, etc.) or combinations thereof on the cutting face 110 of cutting table 102.

In some embodiments, one or more portions (e.g., an entirety) of the cutting table 102 may be polished.

In some embodiments, the cutting element 100 may include one or more surface features (e.g., recesses), such as those disclosed in pending United States Patent Application No. 14/656,036, filed March 12, 2015, and assigned to the assignee of the disclosure, the entire disclosure of which is hereby incorporated herein by this reference.

In some embodiments, the cutting table 102 may be selectively leached to enhance performance of the cutting edge 112 and/or the entire cutting table 102 in a manner similar to that disclosed in U.S. Pat. No. 7,730,977, filed Oct. 3, 2006, the entire disclosure of which is hereby incorporated herein by this reference. For example, the cutting table 102 may include a leached region extending around the outer edge of the cutting face 110 and toward the substrate 104 through a portion of the volume of polycrystalline diamond proximate the sidewall 108 of the cutting table 102. Such a portion may be referred to in the art as a "barrel leach" or "annulus leach."

In some embodiments, only the cutting edge 112 may be leached while the remaining portion of the cutting table 102 is not leached. Such an embodiment may provide an enhanced cutting edge 112 (e.g., having enhanced wear resistance) while retaining the relative strength (e.g., brittleness, toughness) of the remaining cutting table 102 that is not leached.

Figure 3:
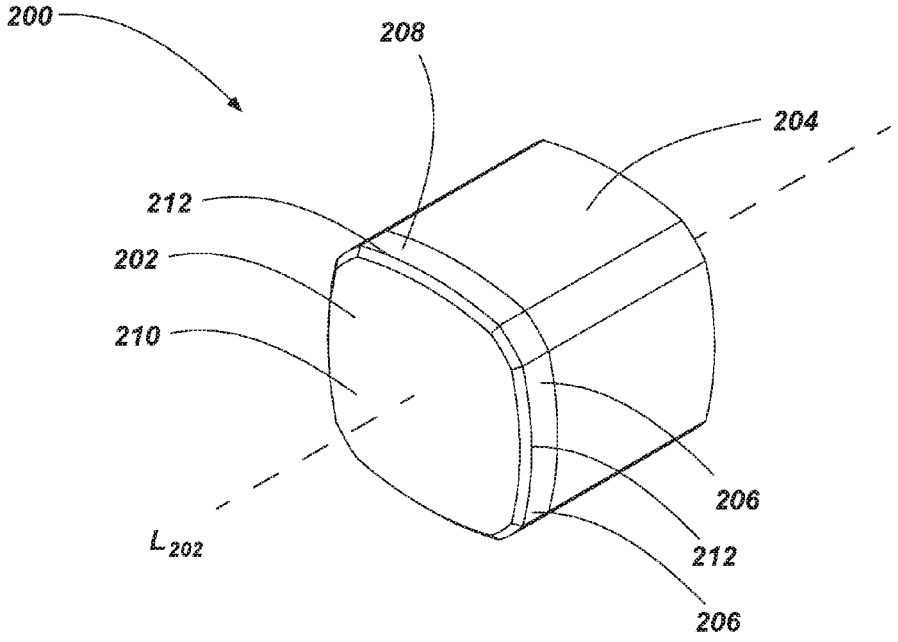
FIG. 3 is a perspective view of a cutting element in accordance with an embodiment of the disclosure.

FIG. 3 illustrates a cutting element 200 that may be similar to and include one or more of the same features and functioning as cutting element 100 discussed above with reference to FIGS. 1 and 2. As shown in FIG. 3, the cutting element 200 includes a cutting table 202 secured (e.g., attached, bonded, etc.) to a supporting substrate 204 at an interface 206. As depicted, the substrate 204 may exhibit a peripheral shape and a peripheral size at least partially complementary to (e.g., substantially similar to) a peripheral geometric configuration of the cutting table 202. For example, the lateral periphery (e.g., extending about a longitudinal axis $L_{202}$ of the cutting table 202) of both the substrate 204 and the cutting table 202 may be substantially uniform. In additional embodiments, the substrate 204 may exhibit a more rounded peripheral shape to be received within a complementary pocket formed in an earth-boring tool.

The cutting table 202 includes at least one sidewall 208 (e.g., four side surfaces or sidewalls 208 extending around the cutting table 202 about the longitudinal axis $L_{202}$ of the cutting table 202), a cutting surface (e.g., cutting face 210) opposite the interface 206 between the supporting substrate 204 and the cutting table 202, and a plurality of cutting edges (e.g., four cutting edges 212) between the sidewall 208 and the cutting face 210 (e.g., at a periphery of the cutting face 210). While FIG. 3 is depicted with four cutting edges 212, in additional embodiments, more or less distinct cutting edges in symmetric or asymmetric configurations may be implemented (e.g., two, three, five, six, or more cutting edges).

Each cutting edge 212 may be defined on the cutting table 202 (and positioned on the overall tool, as discussed below) in order to selectively provide a primary cutting action of the cutting table 202. For example, at least one of cutting edges 212 may be positioned on the cutting table 202 and the overall tool in a position in which the cutting edge 212 will primarily engage a subterranean formation as compared to other portions of the cutting table 202 (e.g., the remaining circumference of the cutting table 202). In some embodiments, each cutting edge 212 of the cutting edges 212 may be, one at a time, selectively positioned on the cutting table 202 and the overall tool in a position in which that cutting edge 212 will primarily engage a subterranean formation. After a selected period of time (e.g., when the cutting element 200 has experienced an amount of wear during use), the cutting element 200 may be rotated such that another cutting edge 212 of the cutting edges 212 is now selectively positioned on the cutting table 202 and the overall tool in a position in which that cutting edge 212 will primarily engage a subterranean formation.

Figure 4:
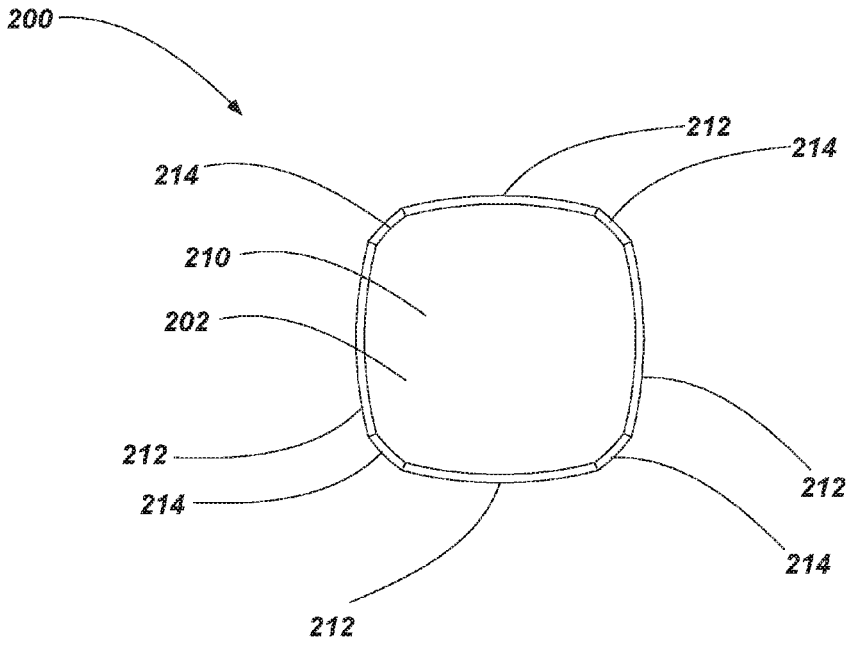
FIG. 4 is a front view of the cutting element of FIG. 3.

FIG. 4 is a front view of the cutting element 200 of FIG. 3. Referring to FIGS. 3 and 4, the radius of curvature that is defined by one or more of the cutting edges 212 (e.g., each cutting edge 212) is greater than the radius of curvature that is defined by the overall cutting table 202. That is, the radius curvature, which is defined by the curvature or outermost extent of each of the cutting edges 212, is greater than the radius of curvature defined by the curvature or outermost extent of the cutting table 202. For example, a reference circle encompassing and bordering minor cutting edges 214 (minor cutting edges 214 extending between and connecting each cutting edge 212) would exhibit a radius of curvature less than the radius of curvature of each of the cutting edges 212. In some embodiments, the radius of curvature of the cutting edges 212 may be one and a tenth times (110%), one and a quarter times (125%), one and a half times (150%), two times (200%), three times (300% or greater) larger than the radius of curvature that is defined by the overall cutting table 202.

In some embodiments, each cutting edge 212 may have a radius of curvature that is substantially equal to the radius of curvature of one or more of the other cutting edges 212. For example, each radius of curvature of the cutting edges 212 may be substantially equal to the radius of curvature of each of the other cutting edges 212.

Figure 5:
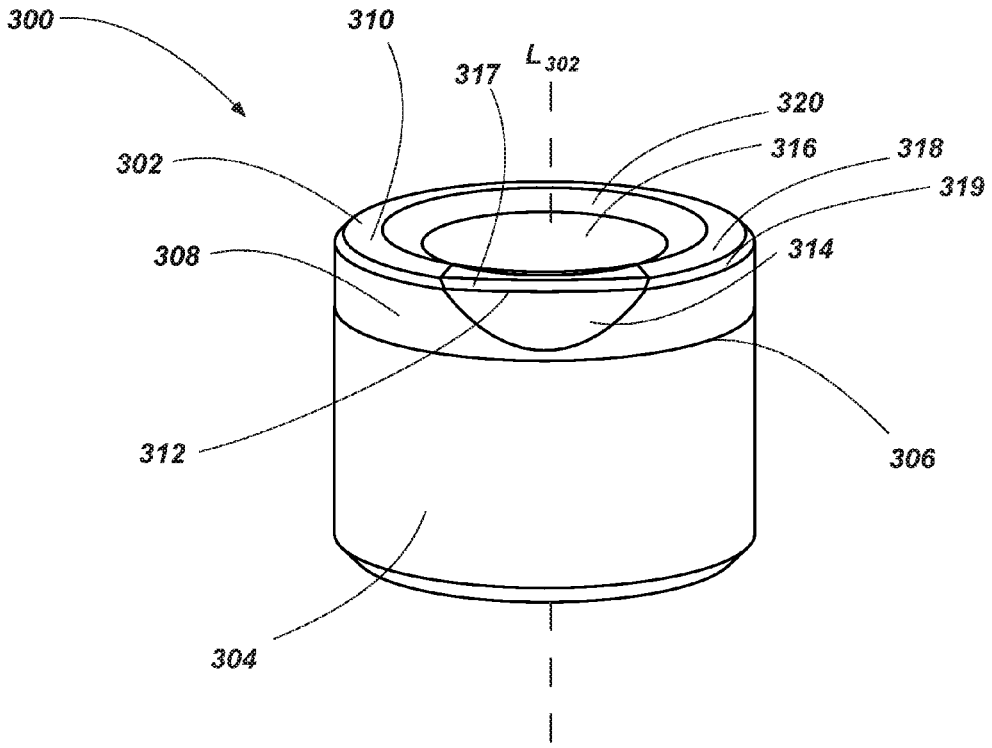
FIG. 5 is a perspective view of a cutting element in accordance with an embodiment of the disclosure.

FIG. 5 illustrates a cutting element 300 that may be similar to and include one or more of the same features and functioning as cutting elements 100, 200 discussed above with reference to FIGS. 1 through 4. As shown in FIG. 5, the cutting element 300 includes a cutting table 302 secured (e.g., attached, bonded, etc.) to a supporting substrate 304 at an interface 306. As depicted, the substrate 304 may exhibit a peripheral shape and a peripheral size at least partially complementary to (e.g., substantially similar to) a peripheral geometric configuration of the cutting table 302. For example, at least a majority (e.g., an entirety) of the lateral periphery (e.g., extending about a longitudinal axis $L_{302}$ of the cutting table 302) of both the substrate 304 and the cutting table 302 may be uniform (e.g., circular or rounded to be received within a complementary rounded hole formed in an earth-boring tool).

The cutting table 302 includes one or more sidewalls 308 (e.g., circular sidewall 308) extending around the cutting table 302 about the longitudinal axis $L_{302}$ of the cutting table 302), a cutting surface (e.g., cutting face 310) opposite the interface 306 between the supporting substrate 304 and the cutting table 302, and one or more cutting edges (e.g., cutting edge 312) between the sidewall 308 and the cutting face 310 (e.g., at a periphery of the cutting face 310). While FIG. 5 is depicted with one cutting edge 312, in additional embodiments, more distinct cutting edges in symmetric or asymmetric configurations may be implemented (e.g., two, three, four, five, six, or more cutting edges).

Cutting edge 312 may be defined on the cutting table 302 (and positioned on the overall tool, as discussed below) in order to selectively provide a primary cutting action of the cutting table 302. For example, cutting edge 312 may be positioned on the cutting table 302 and the overall tool in a position in which the cutting edge 312 will primarily engage a subterranean formation as compared to other portions of the cutting table 302 (e.g., the remaining circumference of the cutting table 302).

Figure 6:
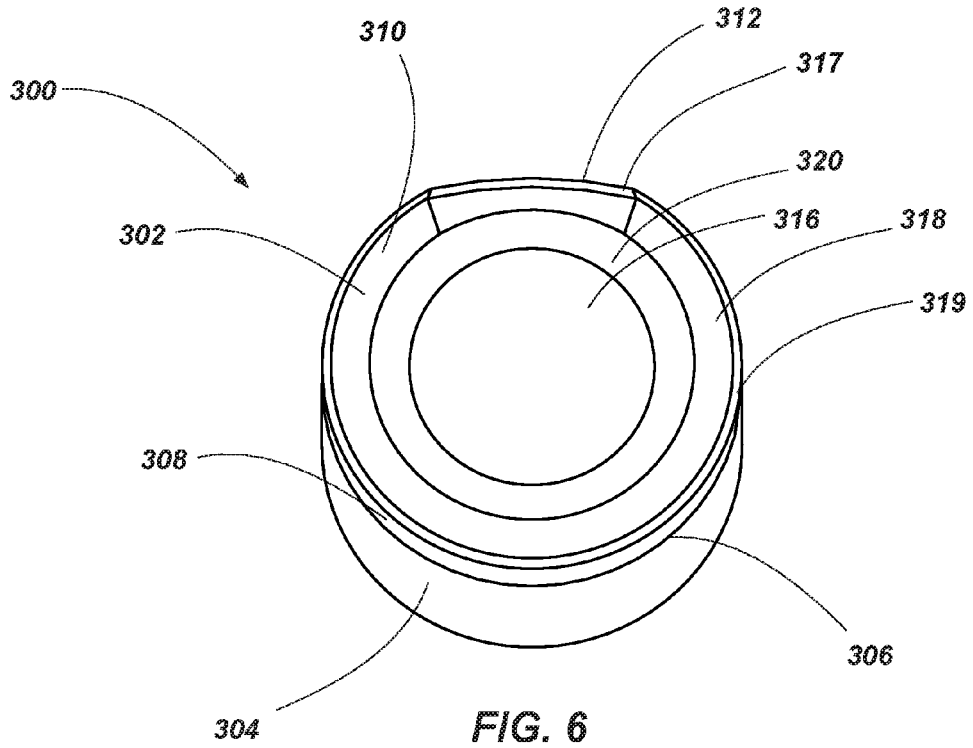
FIG. 6 is a front perspective view of the cutting element of FIG. 5.

FIG. 6 is a front view of the cutting element 300 of FIG. 5. Referring to FIGS. 5 and 6, the radius of curvature that is defined by the cutting edge 312 is greater than the radius of curvature that is defined by the overall cutting table 302. That is, the radius of curvature that is defined by the curvature or outermost extent of the cutting edge 312 is greater than the radius of curvature defined by the curvature or outermost extent of the cutting table 302. For example, a reference circle encompassing and bordering a majority of the cutting table 302 (e.g., about the cutting face 310) would exhibit a radius of curvature less than the radius of curvature of the cutting edge 312. In some embodiments, the radius of curvature of the cutting edge 312 may be one and a tenth times (110%), one and a quarter times (125%), one and a half times (150%), two times (200%), three times (300% or greater) larger than the radius of curvature that is defined by the overall cutting table 302.

As depicted, the cutting edge 312 may be defined in the cutting table 310 by a flattened or tapered portion 314 (e.g., a cutaway portion, an indented portion) in the cutting table 302 extending from the cutting face 310 along the longitudinal axis $L_{302}$ of the cutting table 310 (e.g., toward the interface 206 with the substrate 304). As above, in some embodiments, multiple tapered portions 314 may be defined in the cutting table 310 to provide multiple cutting edges about the cutting table 302. In some embodiments, the tapered portion 314 may be defined in the cutting table 302 (e.g., by machining) where the cutting table 302 originally has a uniform outer radius or diameter. In such an embodiment, a chamfered surface 317 may be defined on the cutting table 302 after the tapered portion 314 is defined (e.g., to substantially match a chamfered surface 319 of the remaining portion of the cutting table 302). In additional embodiments, the tapered portion 314 may be defined during formation of the overall cutting table 310.

In some embodiments, the cutting face 310 may include an embossed or recessed portion 316 in a central portion of the cutting face 310. For example, the cutting face 310 may include a raised lip portion 318 extending around the periphery of the cutting table 302 and about the recessed portion 316 with a transition surface 320 extending between the raised lip portion 318 and the recessed portion 316. In additional embodiments, the cutting face 310 may include a raised or protruding portion. Such embodiments, may act too aid chip manipulation, to aid cutting forces, and/or to aid edge cooling.

Figure 7:
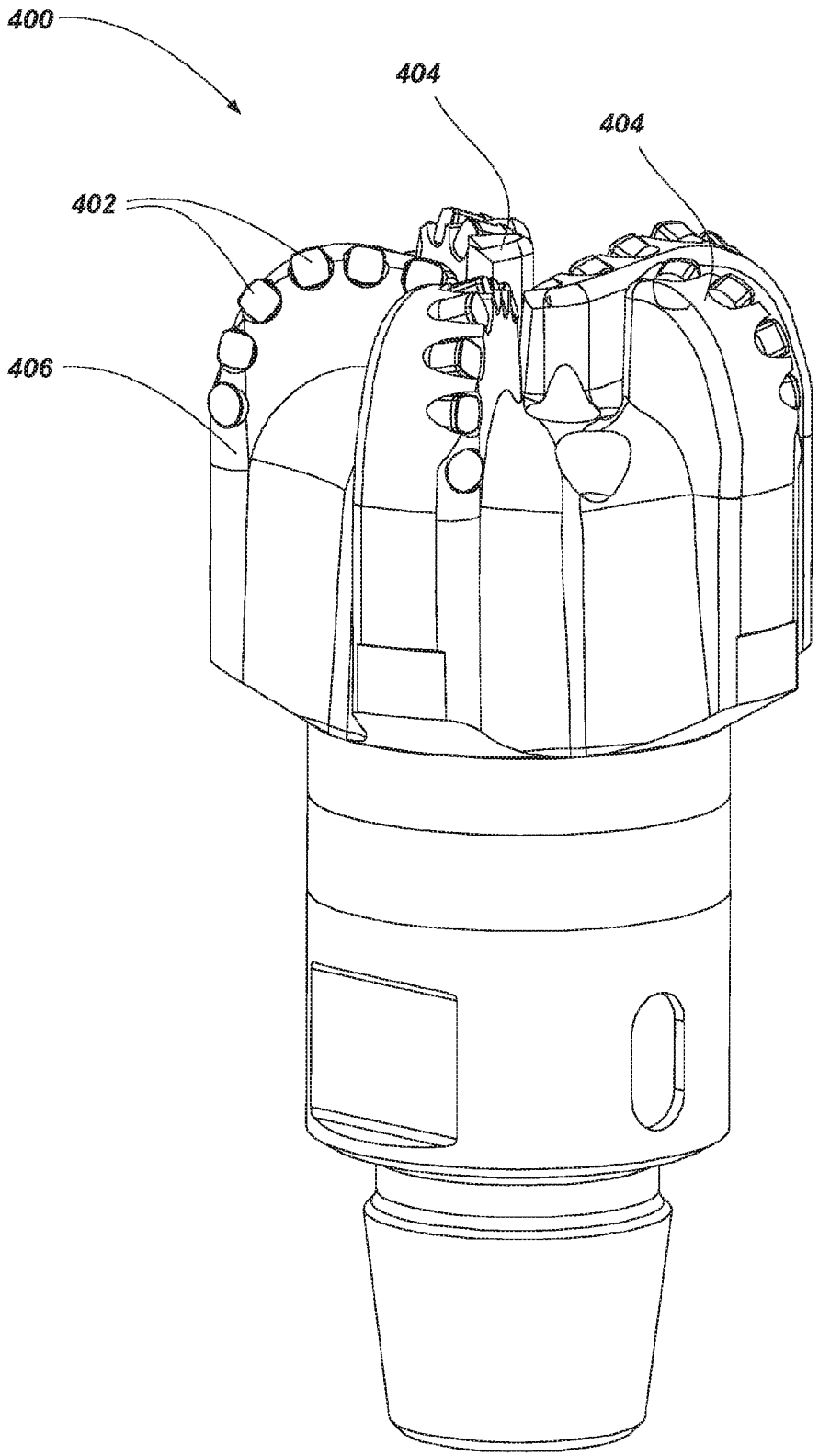
FIG. 7 is a perspective view of an embodiment of an earth-boring tool including cutting elements of the disclosure.

Embodiments of the cutting elements (e.g., the cutting elements 100, 200, 300) described herein may be secured to an earth-boring tool and used to remove material of a subterranean formation. As a non-limiting example, FIG. 7 illustrates a rotary drill bit 400 (e.g., a fixed-cutter rotary drill bit) including cutting elements 402 secured thereto. The cutting elements 402 may, for example, be attached (e.g., welded, brazed, etc.) to one or more blades 404 of a bit body 406 of the rotary drill bit 400. The cutting elements 402 may be positioned at primary and/or secondary (e.g., backup) locations on the bity body 406 and in various regions, such as, for example, the crown, shoulder, cone, and/or gauge of the bit body 404. As discussed above, in some embodiments, the substrate of the cutting elements 402 may exhibit a rounded shape in order to fit within a convention rounded cutting element pocket in the bit body 406. In additional embodiments, the cutting element pocket in the bit body 406 may be formed to be complementary to a non-rounded shape (e.g., non-circular) of the cutting element 402. In yet additional embodiments, the cutting element pocket in the bit body 406 may be oversized relative to a non-rounded shape of the cutting element 402 and material may be added about the cutting element 402 when it is secured to the bit body 406 (e.g., through a brazing process).

In some embodiments, the cutting elements 402 may be substantially similar to one or more of the cutting elements 100, 200, 300 previously described herein with respect to FIGS. 1 through 6. Each of the cutting elements 402 may be substantially the same as each other of the cutting elements 402, or at least one of the cutting elements 402 may be different than at least one other of the cutting elements 402. For example, the drill bit 400 may include a mixture of cutting elements 402 including one or more cutting elements 402 substantially similar to one or more of the cutting elements 100, 200, 300 previously described herein with respect to FIGS. 1 through 6 and one or more conventional cutting elements (e.g., cutting elements lacking the one or more cutting edges disclosed above).

During use and operation, the rotary drill bit 400 may be rotated about a longitudinal axis thereof in a borehole extending into a subterranean formation. As the rotary drill bit 400 rotates, at least some of the cutting elements 402 provided in rotationally leading positions across the blades 404 of the bit body 406 may engage surfaces of the formation defining the borehole with cutting edges (e.g., the cutting edges 112, 212, 312 shown in FIGS. 1 through 6, respectively) thereof and remove (e.g., shear, cut, gouge, etc.) portions of the subterranean formation. In some embodiments, after the cutting edge of at least one of the cutting elements 402 is subjected to a predetermined amount of wear as a result of interactions with the subterranean formation, the cutting element 402 may be rotationally repositioned to provide another cutting edge (where multiple cutting edges are implemented) to provide a new, relatively sharper cutting edge of the cutting element 402. The drilling operation may then continue in a similar manner.

Methods of forming such a cutting element (e.g., cutting elements 100, 200, 300) or an overall earth boring tool (e.g., drill bit 400) may include utilizing an electric discharge machining (EDM) process, another etching or laser cutting process, and another machining process to remove material from one or more of a cutting table and a substrate to form the cutting edges. By way of non-limiting example, referring the FIGS. 1 and 2, one or more of the cutting edges 112 may be formed in the cutting table 102 through at least one laser etching process such as, for example, a laser etching process described in pending United States Patent Pub. No. US 2009/0114628, filed Nov. 5, 2008, and assigned to the assignee of the disclosure, the entire disclosure of which is hereby incorporated herein by this reference.

In additional embodiments, the one or more cutting edges 112 may formed (e.g., pressed, molded, casted, etc.) into a material forming the cutting table 102 during the formation of the cutting table 102.

In yet additional embodiments, the cutting table (e.g., cutting table 302 as shown in FIGS. 5 and 6) may be formed of multiple pieces that are bonded together (e.g., separately or on a substrate 304) to form the cutting table 102.

The cutting elements and earth-boring tools of the disclosure may exhibit increased performance, reliability, and durability as compared to conventional cutting elements and conventional earth-boring tools. The configurations of the cutting elements of the disclosure (e.g., including the peripheral geometric configurations of the cutting tables, and the configurations of the perforations in the sidewall(s) of the cutting tables) advantageously facilitate and maintain aggressive cutting of a subterranean formation. For example, cutting tables include one or more cutting edges having an increased radius of curvature, as disclosed above, may result in the formation of wear flats during use that have a relatively higher aspect ratio as compared to convention cutting elements. For example, a cutting edge having an increased radius of curvature is believed to produce a wear flat that is longer in overall length (e.g., a length along a periphery or circumference of the cutting table) and smaller in overall depth (e.g., a depth extending into the cutting table) as compared to a wear flat on a conventional cutting element. In other words, the ratio of the length of the wear flat formed in the cutting table through wear relative to its depth will be greater, providing a relative higher aspect ratio between these two dimensions of the wear flat in the cutting table. Such a higher aspect ratio wear flat may act to maintain a leached portion of the cutting table, which, as discussed above, provides generally superior performance. In other words, such a higher aspect ratio wear flat will take relatively longer to reach a depth that is below the leached portion of the cutting table; thereby increasing the amount of time that the leached portion of the cutting table is available to engage the formation. In some embodiments, a cutting edge having an increased radius of curvature may also act to produce chips or cuttings from formations that are relatively shallower or have a reduced thickness as compared to those produced by conventional cutting elements. Such chips or cuttings may be easier to break up and remove from the areas proximate the cutting element and the formation where material is being removed from the formation.

EXAMPLE 1

Figure 8:
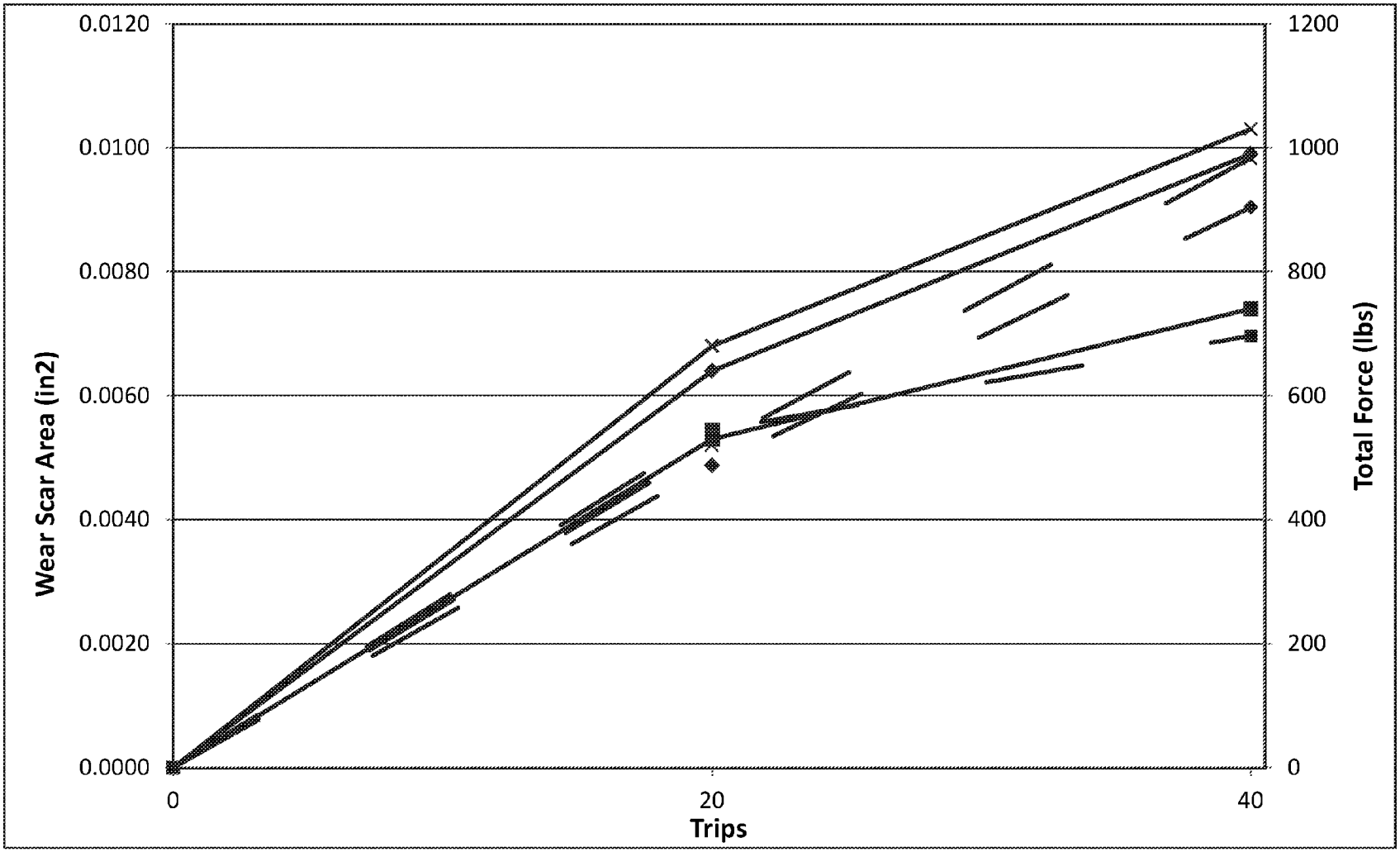
FIG. 8 depicts results of drilling tests performed with cutting elements in accordance with embodiments of the present disclosure and with conventional cutting elements.

FIG. 8 depicts the results of drilling tests performed with cutting elements in accordance with embodiments of the present disclosure and with conventional cutting elements. FIG. 8 shows a graph illustrating the results of multiple passes (forty) performed with cutting elements with conventional cutting tables illustrated by the lines having X-shaped and diamond-shaped markings. FIG. 8 further shows a similar drilling test completed with cutting elements with cutting tables having a relatively larger radius of curvature in accordance with embodiments of the present disclosure illustrated by the lines having square-shaped markings. The graph of FIG. 8 illustrates the number of passes versus the total force (the average axial force during each run) experienced by the cutter (indicated in dashed lines) and the wear scar area (i.e., wear flat) measured after the drilling test (indicated in solid lines).

As can been seen in FIG. 8, the cutting elements with cutting tables having a relatively larger cutting edge radius of curvature in accordance with embodiments of the present disclosure exhibited relatively smaller wear scar areas and relatively less total force as compared to the cutting elements with conventional cutting tables.

Thus, the cutting elements, earth-boring tools, and methods of the disclosure may provide enhanced drilling efficiency as compared to conventional cutting elements, conventional earth-boring tools, and conventional methods.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A cutting element, comprising:

a cutting table of a polycrystalline hard material and, prior to being exposed to wear, comprising:

a cutting face;

a sidewall; and a peripheral cutting edge between the cutting face and the sidewall extending around the cutting element, wherein a radius of curvature of a curved first portion of the peripheral cutting edge is greater than a radius of curvature of an adjacent curved peripheral cutting edge portion of the peripheral edge, the radius of curvature of the adjacent peripheral cutting edge portion being the same as a radius of curvature of the cutting face, wherein an origin of the radius of curvature of the adjacent curved peripheral cutting edge portion lies within a reference circle of the radius of curvature of the curved first portion, and wherein the radius of curvature of the curved first portion intersects the radius of curvature of the adjacent curved peripheral cutting edge portion on each side of the radius of curvature of the curved first portion.

2. The cutting element of claim 1, wherein the peripheral cutting edge comprises a plurality of peripheral cutting edges positioned about a periphery of the cutting table.

3. The cutting element of claim 2, wherein each peripheral cutting edge exhibits substantially the same radius of curvature as each other peripheral cutting edge.

4. The cutting element of claim 3, wherein the peripheral cutting edges are positioned in a circumferentially symmetric manner about the periphery of the cutting face.

5. The cutting element of claim 1, wherein the at least one peripheral cutting edge comprises a leached portion of the cutting table and a remaining portion of the cutting table comprises a non-leached portion of the cutting table.

6. The cutting element of claim 1, wherein the radius of curvature of the cutting face is defined by an outermost extent of the cutting face.

7. The cutting element of claim 1, wherein the peripheral cutting edge is defined along an arc, and wherein at least a majority of the arc extends along a reference circle defining the radius of curvature of the peripheral cutting edge.

8. The cutting element of claim 1, wherein the peripheral cutting edge is configured to be positioned on an earth-boring tool at a location in which the peripheral cutting edge will engage a subterranean formation to remove material therefrom.

9. The cutting element of claim 1, wherein the cutting table is attached to a substrate.

10. The cutting element of claim 9, wherein a lateral periphery of the cutting table comprises a non-circular shape, and wherein the lateral periphery of the substrate comprises a non-circular shape complementary to the lateral periphery of the cutting table.

11. The cutting element of claim 9, wherein a lateral periphery of the cutting face comprises a non-circular shape, and wherein the lateral periphery of the substrate comprises a substantially circular shape.

12. The cutting element of claim 1, wherein the cutting table comprises at least one chamfered surface, and wherein the peripheral cutting edge is positioned at an interface between the at least one chamfered surface of the cutting table and the sidewall.

13. The cutting element of claim 1, wherein the peripheral cutting edge is adjacent a taper in the sidewall of the cutting table extending from the peripheral cutting edge toward an opposing side of the cutting table.

14. The cutting element of claim 1, wherein the cutting face comprises at least one recess in a central portion of the cutting face at a centerline of the cutting element extending through the cutting table of the cutting element.

15. An earth-boring tool, comprising:

cutting elements secured to at least one structure, at least some of the cutting elements independently comprising prior to being exposed to wear:

a cutting table comprising a polycrystalline compact of hard material, the cutting table comprising:

a cutting face;

a sidewall; and at least one arced peripheral cutting edge portion positioned between the cutting face and the sidewall, the at least one peripheral cutting edge portion positioned at an outermost extent of the cutting element, wherein the at least one peripheral cutting edge portion is positioned on the at least one structure at a location in which the at least one peripheral cutting edge portion will engage a subterranean formation to remove material therefrom during operation of the earth-boring tool, and wherein a radius of curvature of an outermost extent of the at least one peripheral cutting edge portion is greater than a radius of curvature of an outermost extent of the cutting table, wherein an entirety of the cutting table lies within both a first reference circle defined by the radius of curvature of the outermost extent of the at least one peripheral cutting edge portion and a second reference circle defined by the radius of curvature of the outermost extent of the cutting table.

16. The earth-boring tool of claim 15, wherein an entirety of the at least one peripheral cutting edge portion defines along an arc extending along a reference circle defining the radius of curvature of the at least one peripheral cutting edge portion.

17. The earth-boring tool of claim 15, wherein a reference circle defining the radius of curvature of the cutting table encompasses and bounds the cutting table.

18. The earth-boring tool of claim 15, wherein the at least one peripheral cutting edge portion comprises peripheral cutting edge portions positioned about a periphery of the cutting table.

19. The earth-boring tool of claim 18, wherein each peripheral cutting edge portion of the peripheral cutting edge portions is configured to be selectively positioned on the at least one structure in a position where the respective peripheral cutting edge portion will primarily engage a subterranean formation as compared to other portions of the cutting table during operation of the earth-boring tool.

20. An earth-boring tool, comprising:

cutting elements secured to at least one structure, at least some of the cutting elements independently comprising:

a cutting table comprising a polycrystalline compact of hard material, the cutting table comprising:

a cutting face;

at least one sidewall;

a chamfered surface extending between the cutting face and the at least one sidewall; and peripheral cutting edge portions defined at at least one interface between the chamfered surface and the at least one sidewall, at least one peripheral cutting edge portion of the peripheral cutting edge portions being positioned at an outermost radial extent of the cutting element, wherein each peripheral cutting edge portion of the peripheral cutting edge portions is configured to be selectively positioned on the at least one structure in a position where the respective peripheral cutting edge portion will engage a subterranean formation to remove material therefrom, and wherein a radius of curvature comprising a natural number of each of the peripheral cutting edge portions is greater than a radius of curvature of at least another peripheral edge portion of the cutting table between the cutting face and the at least one sidewall, wherein an entirety of the cutting table lies within a reference circle defined by the radius of curvature of the at least another peripheral edge portion of the cutting table.

* * * * *